US005218935A

United States Patent [19]

Quinn, Jr. et al.

[11] Patent Number: 5,218,935

[45] Date of Patent: Jun. 15, 1993

[54] VCT SYSTEM HAVING CLOSED LOOP CONTROL EMPLOYING SPOOL VALVE ACTUATED BY A STEPPER MOTOR

[75] Inventors: Stanley B. Quinn, Jr.; Edward C. Siemon, both of Ithaca, N.Y.

[73] Assignee: Borg-Warner Automotive Transmission & Engine Components Corporation, Sterling Heights, Mich.

[21] Appl. No.: 940,273

[22] Filed: Sep. 3, 1992

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 160

[56] References Cited

U.S. PATENT DOCUMENTS

| | | | |
|---|---|---|---|
| 4,858,572 | 8/1989 | Shirai et al. | 123/90.31 |
| 4,895,113 | 1/1990 | Speier et al. | 123/90.31 |
| 4,903,650 | 2/1990 | Ohlendorf et al. | 123/90.31 |
| 5,002,023 | 3/1991 | Butterfield et al. | 123/90.17 |
| 5,046,460 | 9/1991 | Butterfield et al. | 123/90.17 |
| 5,056,477 | 10/1991 | Linder et al. | 123/90.31 |
| 5,107,804 | 4/1992 | Becker et al. | 123/90.17 |
| 5,172,659 | 12/1992 | Butterfield et al. | 123/90.17 |

FOREIGN PATENT DOCUMENTS

| | | | |
|---|---|---|---|
| 3922962 | 1/1991 | Fed. Rep. of Germany | 123/90.31 |

*Primary Examiner*—E. Rollins Cross

*Assistant Examiner*—Weilun Lo

*Attorney, Agent, or Firm*—Willian Brinks Olds

[57] ABSTRACT

A camshaft (26) has a vane (60) secured to an end thereof for non-oscillating rotation therewith. The camshaft also carries a sprocket (32) which can rotate with the camshaft but which is oscillatable with respect to the camshaft. The vane has opposed lobes (**60*a*, 60*b*) which are received in opposed recesses (32*a*, 32*b*), respectively, of the sprocket. The recesses have greater circumferential extent than the lobes to permit the vane and sprocket to oscillate with respect to one another, and thereby permit the camshaft to change in phase relative to a crankshaft whose phase relative to the sprocket is fixed by virtue of a chain drive extending therebetween. The camshaft experiences pulses during its normal operation, and these pulses are used to change its phase with respect to the crankshaft. The camshaft is permitted to change only in a given direction, either to advance or retard, by selectively blocking or permitting the flow of hydraulic fluid, preferably engine oil, through the return lines (94, 96) from the recesses by using a stepper motor (134). The stepper motor serves to control the position of a spool (100) within a valve body (98) of a control valve in response to a signal indicative of an engine operating condition determined from a closed loop feedback system (108) which utilizes a predetermined set point, r (35**), to dictate the desired camshaft phase angle to effectuate certain engine performance criteria.

29 Claims, 15 Drawing Sheets

VCT SYSTEM HAVING CLOSED LOOP CONTROL EMPLOYING SPOOL VALVE ACTUATED BY A STEPPER MOTOR

FIELD OF THE INVENTION

This invention relates to an internal combustion engine in which the timing of the camshaft of a single camshaft engine, or the timing of one or both of the camshafts of a dual camshaft engine, relative to the crankshaft, is varied to improve one or more of the operating characteristics of the engine.

BACKGROUND OF THE INVENTION

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. It is also known that engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft. Heretofore, such changes in engine valve timing have been accomplished by a separate hydraulic motor operated by engine lubricating oil. However, this actuating arrangement consumes significant additional energy and it increases the required size of the engine lubricating pump because of the required rapid response time for proper operation of the camshaft phasing actuator. Further, these arrangements are typically limited to a total of 20° of phase adjustment between crankshaft position and camshaft position, and typically such arrangements are two-position arrangements, that is, on, or fully phase adjusted as one position, and off, or no phase adjustment, as a second position.

The present invention is designed to overcome the aforesaid problems associated with prior art variable camshaft timing arrangements by providing a self-actuating, variable camshaft timing arrangement which does not require external energy for the operation thereof, which does not add to the required size of the engine lubricating pump to meet transient hydraulic operation requirements of such variable camshaft timing arrangement, which provides for continuously variable camshaft to crankshaft phase relationship within its operating limits, and which provides substantially more than 20° of phase adjustment between the crankshaft position and the camshaft position. Prior U.S. Pat. Nos. which describe various systems of the foregoing type are 5,046,460 and 5,002,023, the disclosures of each of which are incorporated by reference. Those disclosures provide a pulse-width modulated (PWM) solenoid for varying the position of a control valve which actuates the VCT phase adjustment mechanism. Closed-loop control of those VCT systems was disclosed in U.S. patent application Ser. No. 07/847,577, the disclosure of which is incorporated herein by reference. This technology is acceptable for chain driven engines, but it is less than desirable in belt-driven engines where the PWM equipment may leak oil on the belt thus causing slippage and a decrease in engine efficiency.

SUMMARY OF THE INVENTION

The present invention provides a method for phase adjustment of an internal combustion engine in which the position of the camshaft, or the positions of one or both of the camshafts in a dual camshaft system, is phase adjusted relative to the crankshaft by an actuating arrangement which is controlled by a closed loop system which commands a stepper motor. A predetermined set point dictates the desired camshaft phase angle for certain engine performance criteria. This variable camshaft timing (VCT) system can be used to improve important engine operating characteristics such as idle quality, fuel economy, emissions or torque. A preferred embodiment of a camshaft mounted hydraulic VCT mechanism uses one or more radially extending vanes which are circumferentially fixed relative to the camshaft and which are receivable in cavities of a sprocket housing that is oscillatable on the camshaft. Hydraulic fluid is selectively pumped through a proportional (spool) valve to one side or another of each vane to advance or retard the position of the camshaft relative to the sprocket. A pumping action occurs in reaction to a signal generated by a closed loop feedback system. Closed loop feedback control is imperative for any but the "two-position" case, i.e., fully advanced or fully retarded. This is because camshaft phase is controlled by the integral of the spool valve position. That is, spool position corresponds not to camshaft phase, but to its rate of change. Thus, any steady state spool position other than null (centered) will cause the VCT to eventually go to one of its physical limits in phase. Closed loop control allows the spool to be returned to null as the camshaft phase reaches its commanded position or set point. An additional result of using feedback control is that the system performance is desensitized to mechanical and environmental variations. This results in a reduction of the effects of short term changes, such as changes in oil pressure or temperature, or long term variations due to tolerances or wear. In addition, set point tracking error in the presence of unanticipated disturbances (e.g. torque shifts) is reduced. The use of VCT state variable feedback opens up the possibility of using "optimal" control to best achieve a wide variety of performance objectives. In addition, integral control can be incorporated into this technique to ensure zero steady-state tracking error.

Accordingly, it is an object of the present invention to provide an improved VCT method and apparatus which utilizes an electronic driver and stepper motor for spool position control and an advanced control algorithm that yields a prescribed set point tracking behavior. Specifically, it is an object of the present invention to provide a VCT system which utilizes a predetermined set point to dictate the desired camshaft phase angle to effectuate certain engine performance criteria. A further object of the present invention is to provide an improved VCT method and apparatus which does not rely upon oil pressure for spool valve control thus allowing the system to be accurately positioned at engine start-up when system oil pressure is usually low. Another object of the current invention is to provide a VCT system for belt-driven engines which utilizes a stepper motor for spool valve control thus avoiding leakage of hydraulic fluid onto the belt from a hydraulically controlled spool valve, such as a pulse-width-modulated solenoid.

For a further understanding of the present invention and the objects thereof, attention is directed to the drawings and to the following brief descriptions thereof, to the detailed description of the preferred embodiment, and to the appended claims.

BRIEF DESCRIPTION OF THE DRAWING

FIG. 1*g* is a block diagram of an alternate closed-loop feedback system similar to FIG. la but also having a synchronous filter in the controller;

DETAILED DESCRIPTION OF THE PREFERRED EMBODIMENT

Figure 1A:
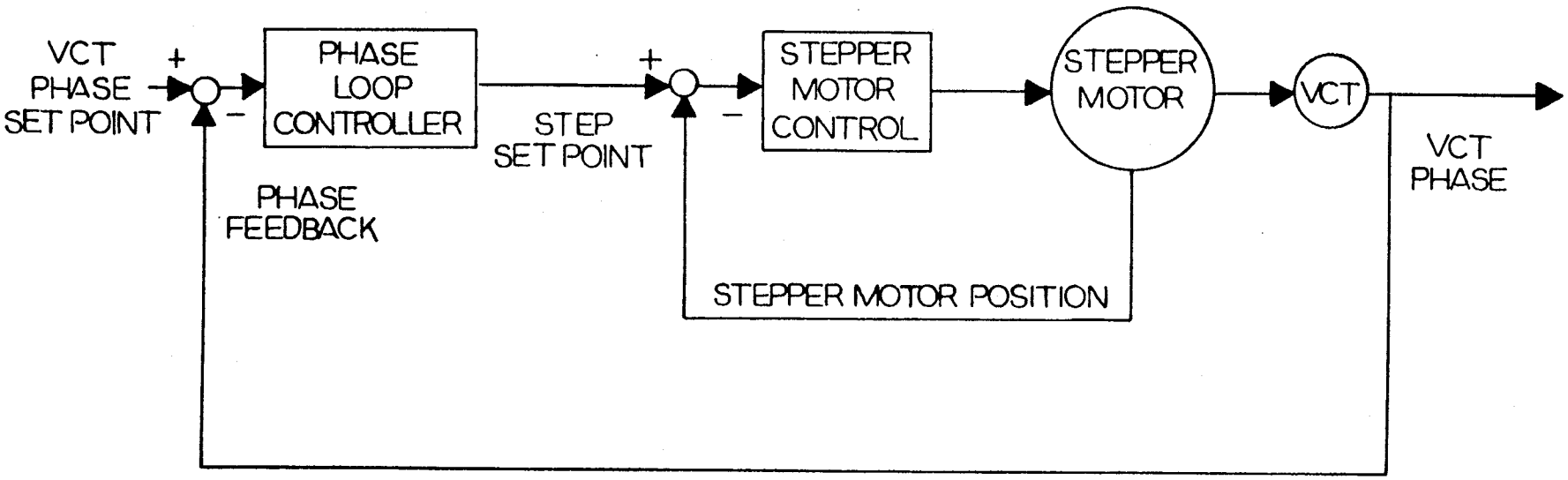
FIG. 1*a* is a block diagram of a basic closed loop feedback system for a VCT system utilizing a stepper motor for phase shift actuation.

A simplified diagram of a closed-loop control system for a VCT mechanism using a stepper motor is shown in FIG. 1*a*. The phase feedback is compared to a desired phase set point and the difference is input to a phase loop controller. The controller calculates a stepper motor position which is compared to present stepper motor position. A stepper motor control unit issues a signal to the stepper motor to move it an appropriate distance. The VCT mechanism is then actuated by the stepper motor movement which changes its position relative to a crankshaft.

Figure 1B:
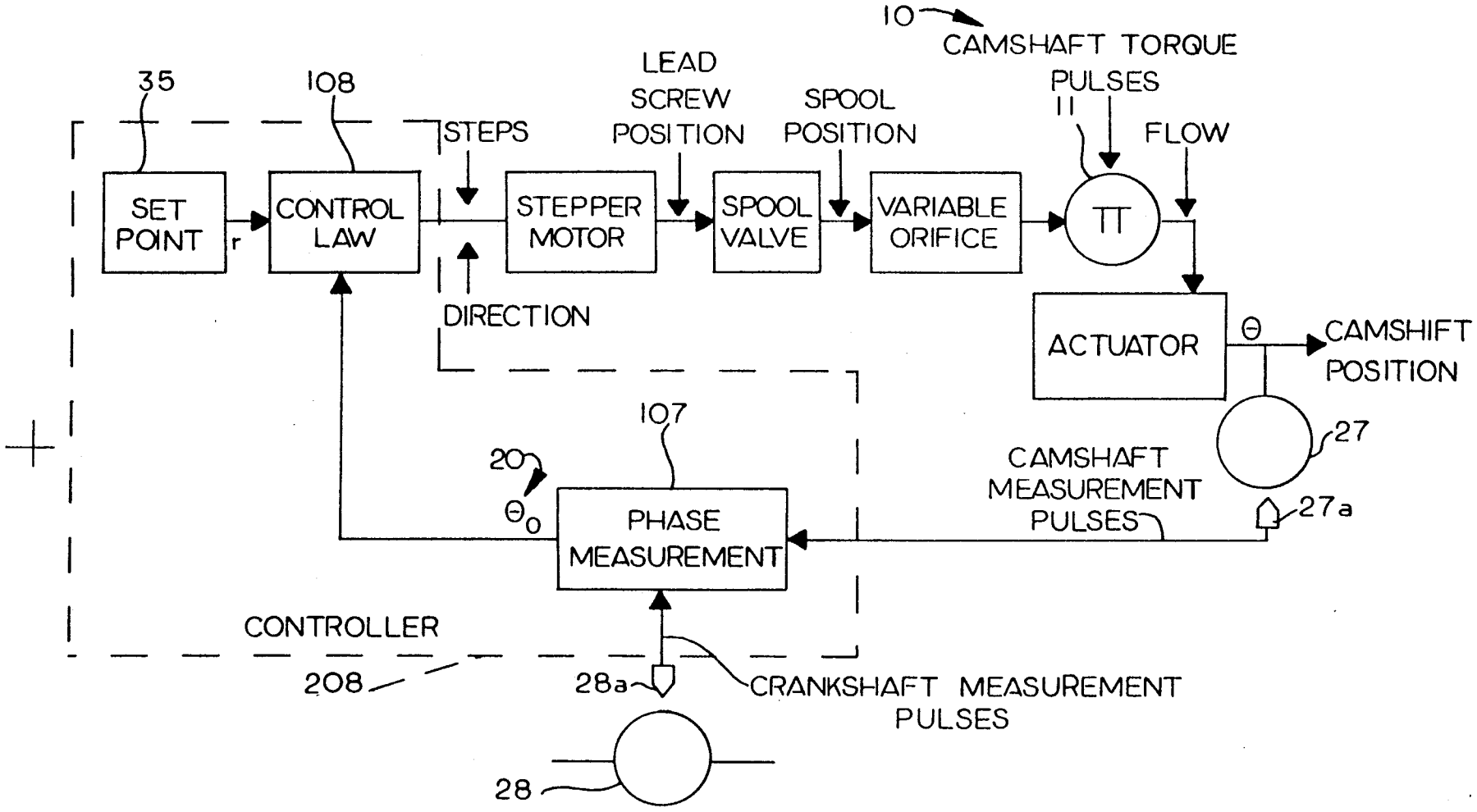
FIG. 1*b* is a block diagram of a closed loop feedback system for a VCT system similar to FIG. 1*a* with additional detail of control elements.
Figure 11:
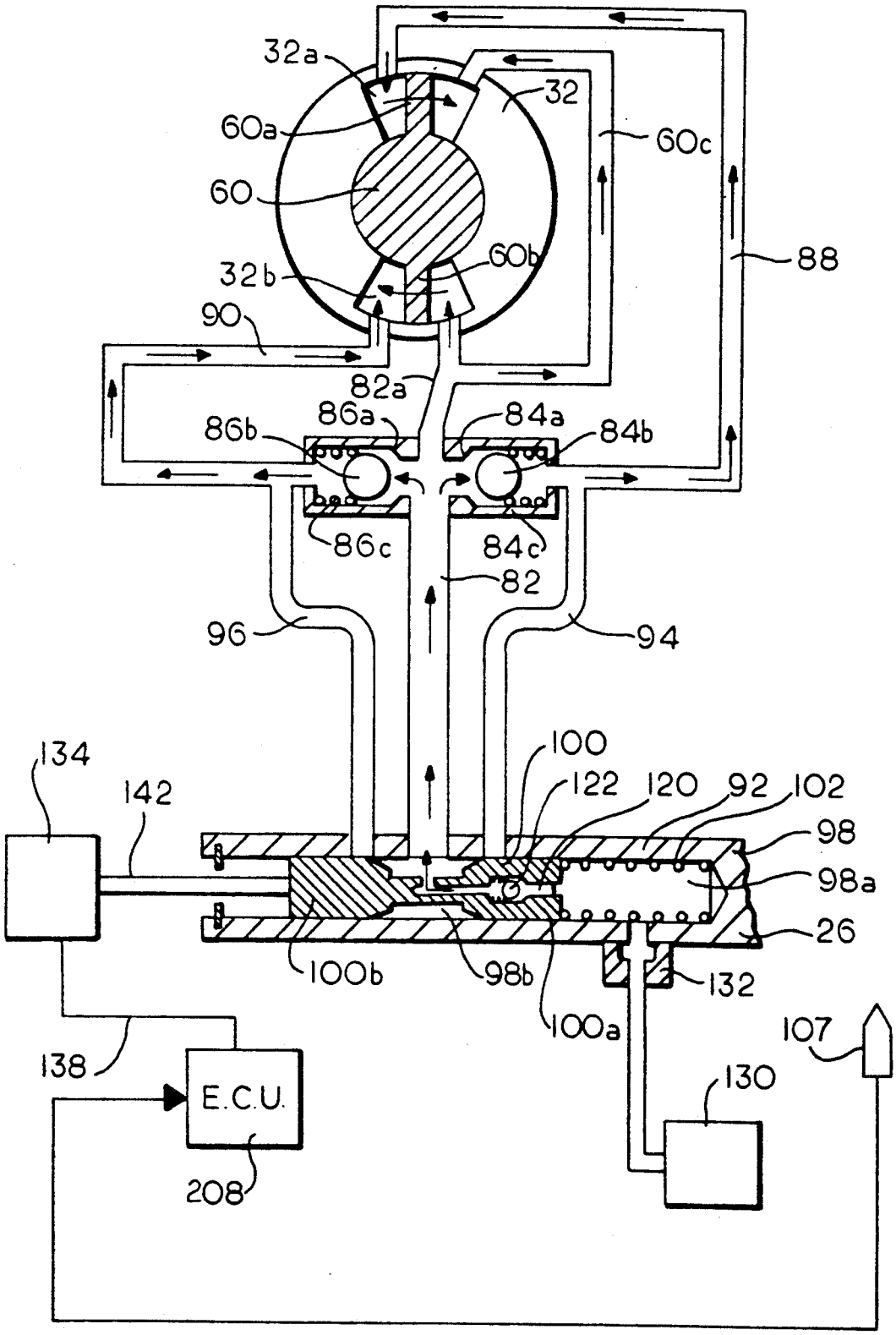
FIG. 11 is a simplified schematic view of the VCT arrangement of FIGS. 2-10.

As is schematically shown in FIGS. 1*b* and 11, the control objective of the present invention is to have the VCT mechanism at the phase angle given by the set point 35 with the spool 100 stationary in its null position. That is, the VCT mechanism is at the correct phase and the phase rate of change is zero. A sophisticated control algorithm which utilizes the dynamic state of the VCT mechanism is used to accomplish this result. Closed-loop control of the VCT mechanism is achieved by measuring the camshaft phase shift $\Theta_o$20, comparing it to the desired set point r 35, and adjusting the VCT mechanism so the phase follows the set point r 35. The control law 108 compares the set point r 35 to the phase shift $\Theta_o$20 and issues commands to stepper motor 134 in order to position the spool 100 when the phase error (set point r 35 minus phase shift 20) is not zero. The spool 100 is stepped to the right if the phase error is positive (retard) and to the left if the phase error is negative (advance). When the phase error is zero, the VCT phase equals the set point r 35 so the spool 100 is held in the null position (as shown in FIG. 11).

Camshaft and crankshaft measurement pulses in the VCT system are generated by camshaft and crankshaft pulse wheels 27 and 28, respectively, as the crankshaft (not shown) and camshaft 26 are rotated, and these can be used to actuate the operation of one or more hydraulic elements of a hydraulically operated VCT system. According to the present invention, in a VCT system, for example, a system as described in the aforesaid U.S. Pat. Nos. 5,046,460 and 5,002,023, and U.S. patent application Ser. No. 07/847,577, or according to the embodiment of FIGS. 2-10 as hereinafter described, the measurement pulses are detected by camshaft and crankshaft measurement pulse sensors 27*a* and 28*a*, respectively, and issued to a phase measurement device 107. The time from successive crank-to-cam pulses, divided by the time for an entire revolution and multiplied by 360°, gives the measured phase difference, $\Theta_o$20. This phase difference is then supplied to the control law 108 for processing.

Figure 1C:
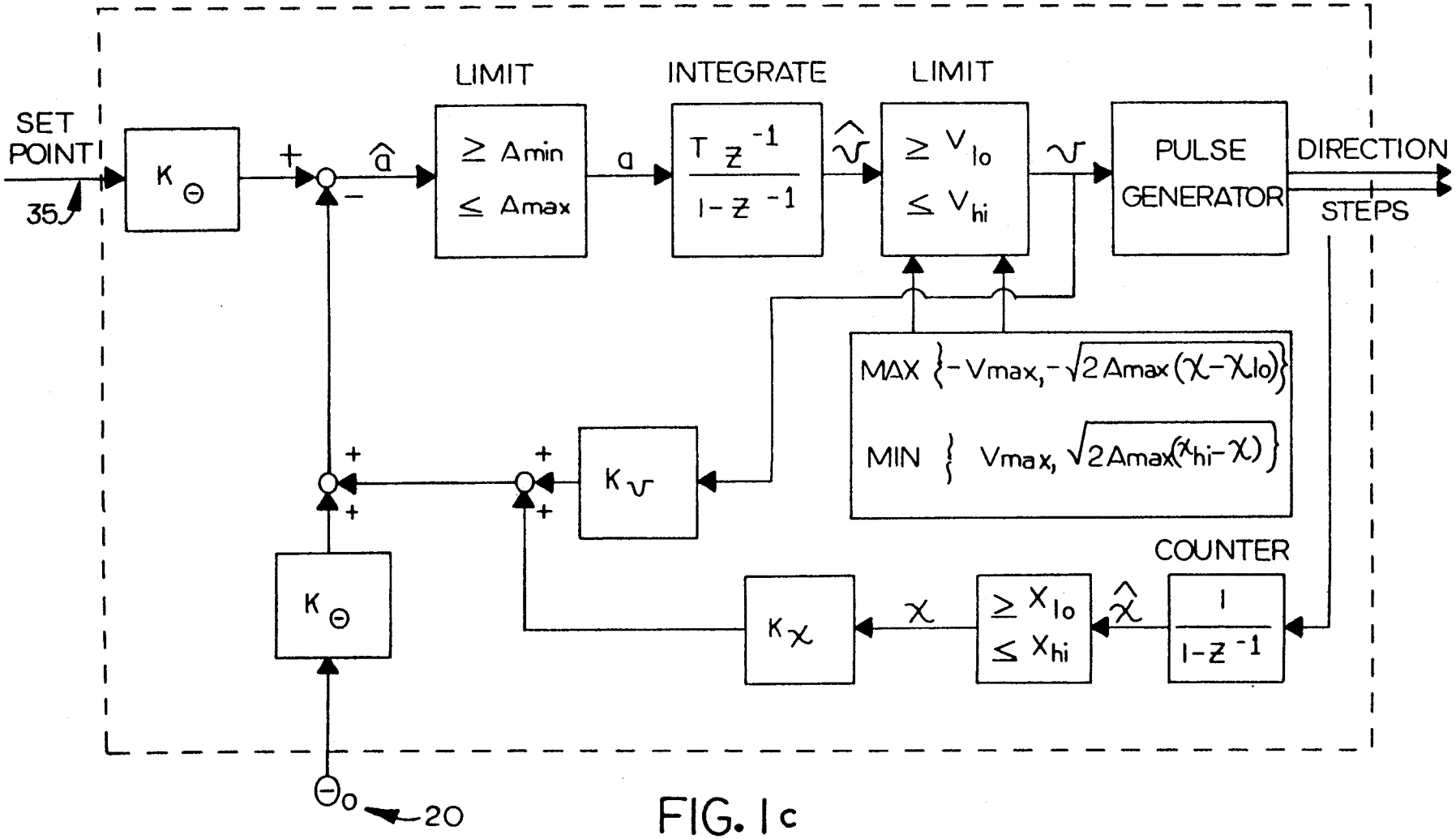
FIG. 1*c* is a block diagram of the VCT control law used in a closed loop feedback system of a preferred embodiment of the present invention.

A closed-loop block diagram of the control law 108 is described in detail in FIG. 1*c*. The stepper motor 134 acceleration command is uniquely determined from a control algorithm which is a function of the following three VCT system state variables: VCT phase difference $\Theta_o$20, spool 100 position (rate of VCT phase change), and spool 100 velocity. The set point r 35 and the phase difference 20 are each multiplied by proportional gain $K_{73}$. The difference between those computed values, less the computed velocity and position feedback values, yields a raw acceleration.

The acceleration is then limited and integrated to yield a raw velocity. The control algorithm maintains spool 100 velocity as an internal variable. The spool 100 velocity is limited by three factors. First, it cannot exceed its maximum velocity. Second, its derivative must be less than its maximum acceleration. Finally, as the spool 100 approaches its physical limits, its velocity must ramp to zero so that it does not introduce an error in the step count. The equations which correspond to these limits are as follows:

$A_{sax} = -A_{sin}$ (set by manufacturer for maximum load)

$V_{sax} = -V_{sin}$ (set by manufacturer specifications)

$V_{10} = \max\{-V_{sax}, -(2*A_{sax}*[X-X_{10}])^{\frac{1}{2}}\}$ $V_{hi} = \min\{V_{sax}, (2*A_{sax}*[X_{hi}-X])^{\frac{1}{2}}\}$ $X_{hi}, X_{lo}$ = set by mechanical stops in spool valve 92.

Figure 1D:
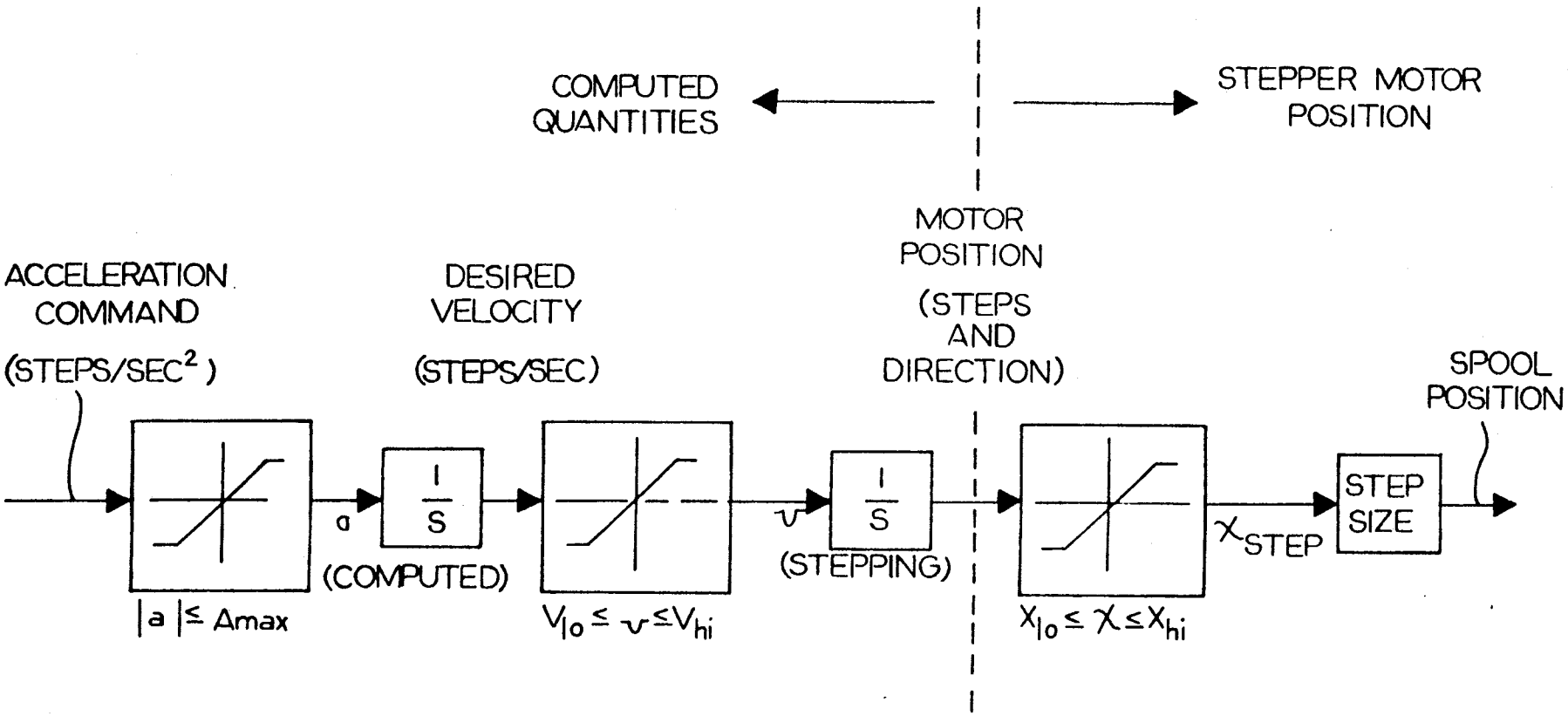
FIG. 1*d* is a block diagram of a control system for the stepper motor and spool valve of a VCT system of the present invention.
Figure 1E:
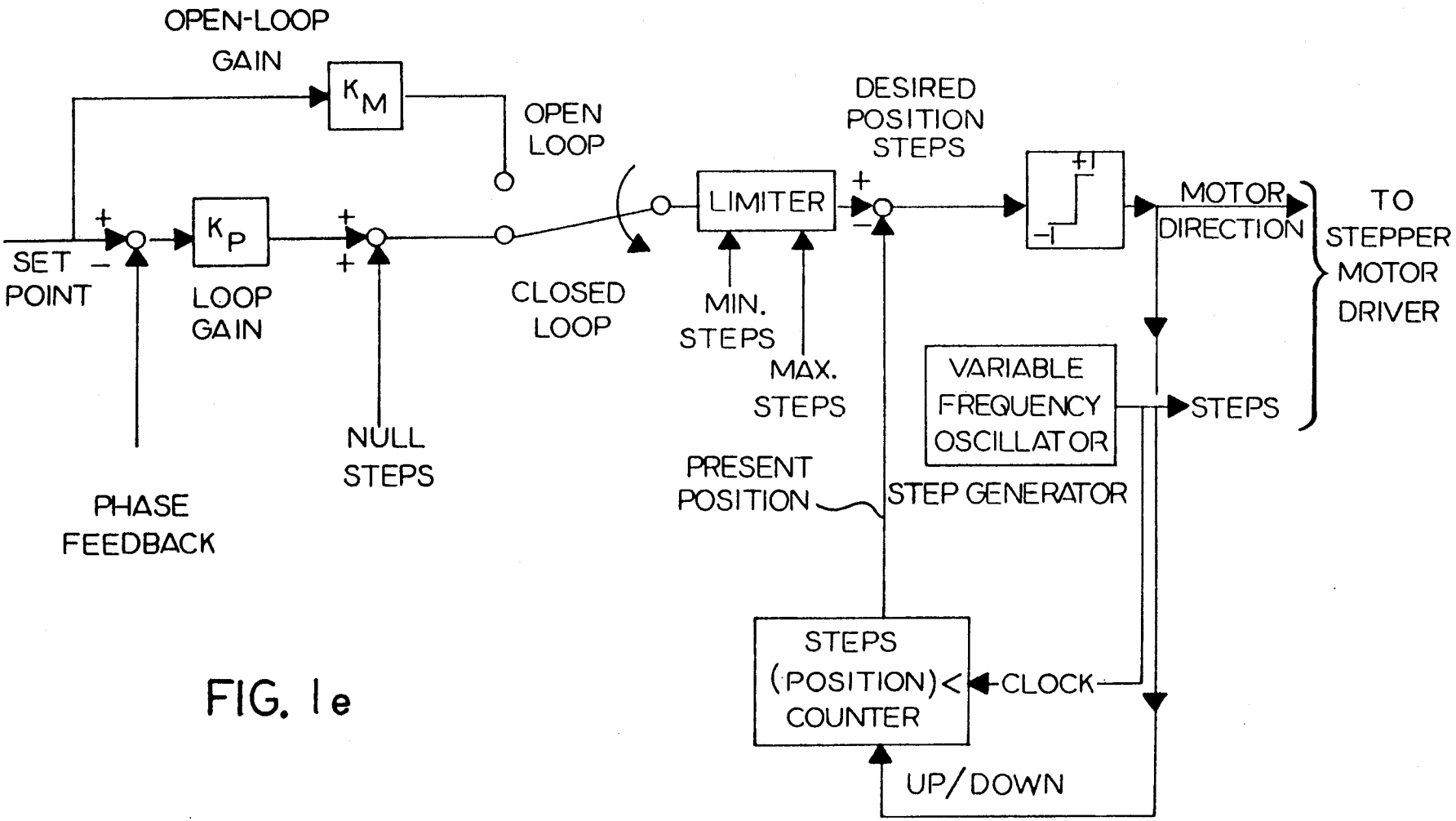
FIG. 1*e* is a block diagram showing closed loop control of a VCT system using a stepper motor.

The feedback gains, $K_v$, $K_x$, and $K_o$, are selected to give a one (1) Hertz sinusoidal response of −3dB (decibels) at −45 degree phase lag, but other gains can be selected to obtain a different response. In addition, spool 100 position is tracked by counting the step commands as described above. In essence, although the control algorithm is not based on commanding the spool to a specific position, the ability to keep track of the spool 100 position and velocity allows better closed-loop control. A model for stepper motor 134 position based on the control algorithm discussed above is shown in FIG 1*d*. As long as the stepper motor 134 step rate does not exceed the prescribed velocity, the stepper motor 134 position corresponds exactly to spool 100 position. FIG 1*e* is a block diagram of an alternative stepper motor step computation and tracking method.

Figure 1F:
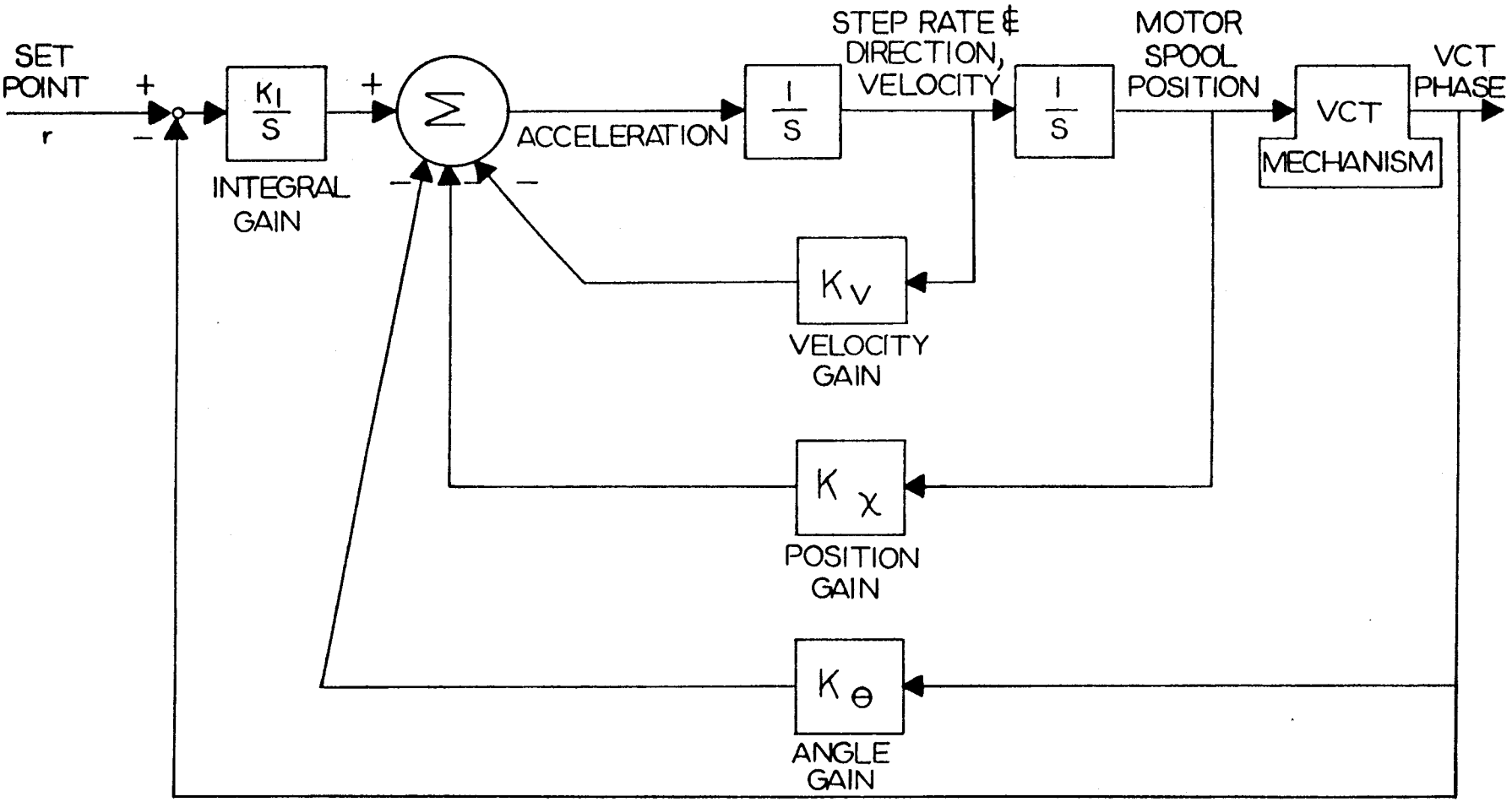
FIG. 1*f* is a block diagram of the control law with integral control and state feedback for a stepper motor in a VCT system of the present invention.
Figure 19:
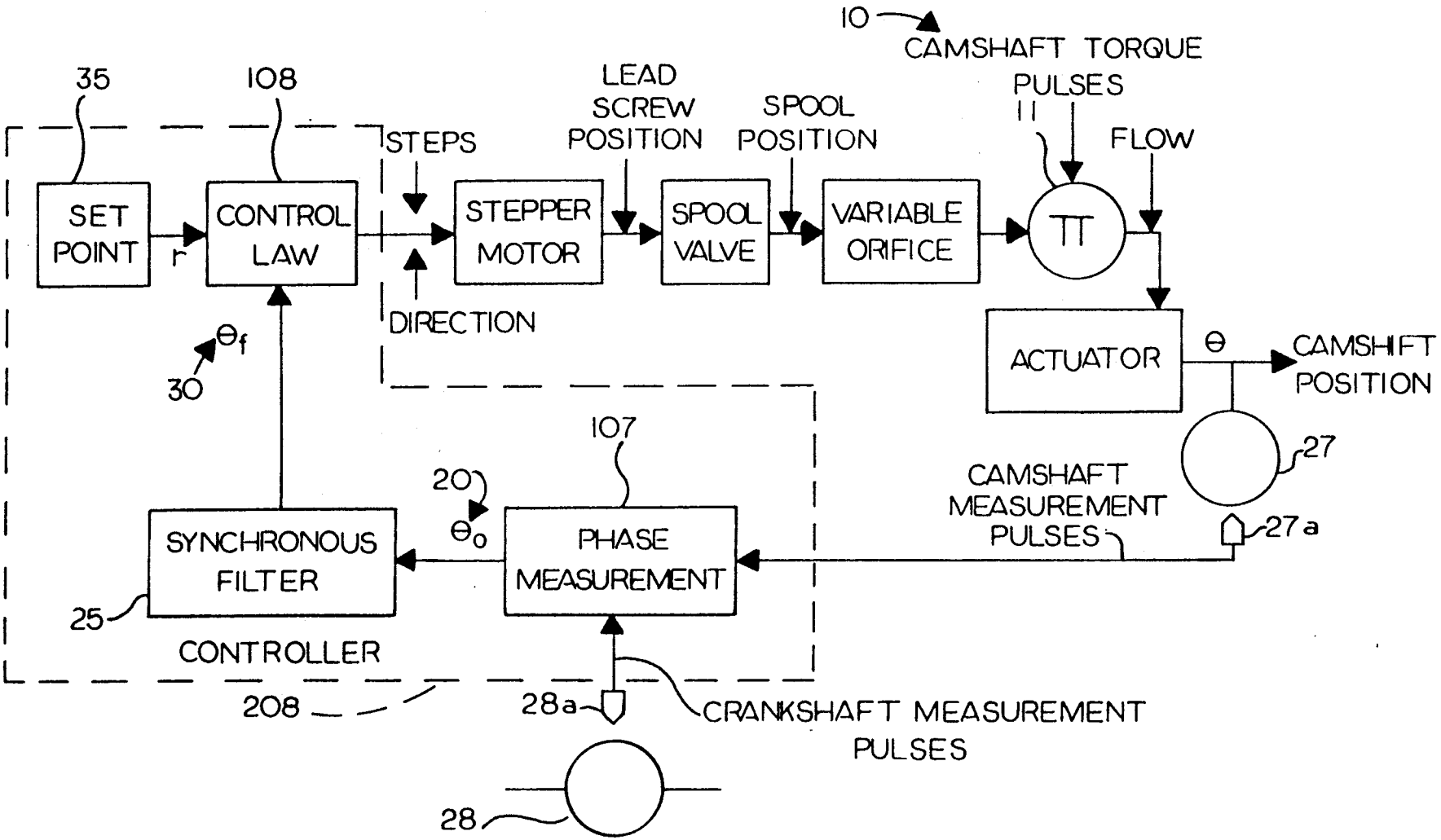

Integral control of the VCT system can be introduced in order to ensure zero steady-state tracking error. That is, a constant set point r 35 will be reached exactly. The integral of the phase error, set point minus phase feedback, becomes a fourth state variable. It is multiplied by an additional feedback gain, $K_I$, and added into the acceleration command as shown in FIG. 1*f*. Optimal control laws can also be developed for this system.

An alternate embodiment of the present invention consists of an expanded closed loop feedback system including variation compensation and disturbance feed forward. The gain of this hydromechanical system depends on a number of variables such as hydraulic supply pressure, engine speed, oil temperature and natural crankshaft/camshaft orientation. In order to counteract the phenomena in the controller, the net effect of all the variables is estimated and a proportional gain is increased as response decreases.

FIG. 1*g* illustrates an embodiment of the present invention with a synchronous filter 25 in the controller 208 for filtering the measured phase shift $\Theta_o$ 20. As the camshaft rotates, the torque pulses 10 superimpose a high frequency disturbance on the measured phase shift, $\Theta_o$20. Thus, there is an exact synchronization between the torque pulses 10 and the high frequency disturbance. Likewise, the camshaft measurement pulses 27*a* are also synchronized with the disturbance. It is possible to take advantage of this synchronization to efficiently filter the phase measurement, $\Theta_o$20, so that the high frequency disturbance is isolated from the control action. As the camshaft speed varies, the filter frequency automatically tracks the disturbance frequency. The filter itself is a discrete-time notch filter with a sampling frequency equal to that of the camshaft measurement pulse frequency 27*a*. The filtered phase measurement, $\Theta_f$30, is supplied to control law 108 and processed as discussed above. Since the high frequency disturbance is isolated, the control law 108 does not attempt to compensate for it. This further makes it possible to save actuation power, reduce wear and enhance signal linearity by such a filtering step.

Figure 1H:
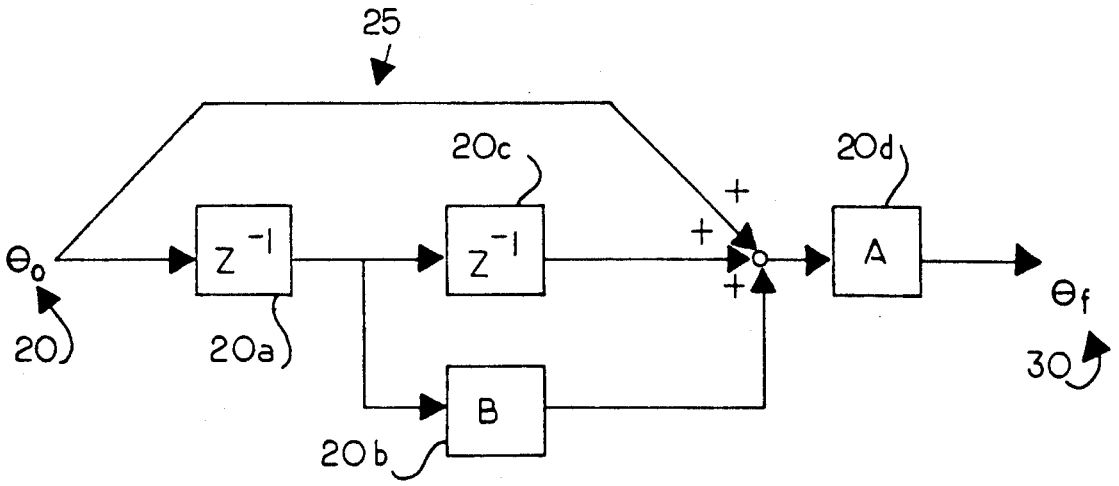
FIG. 1*h* is a block diagram illustrating the component stages of a synchronous feedback filter.
Figure 2:
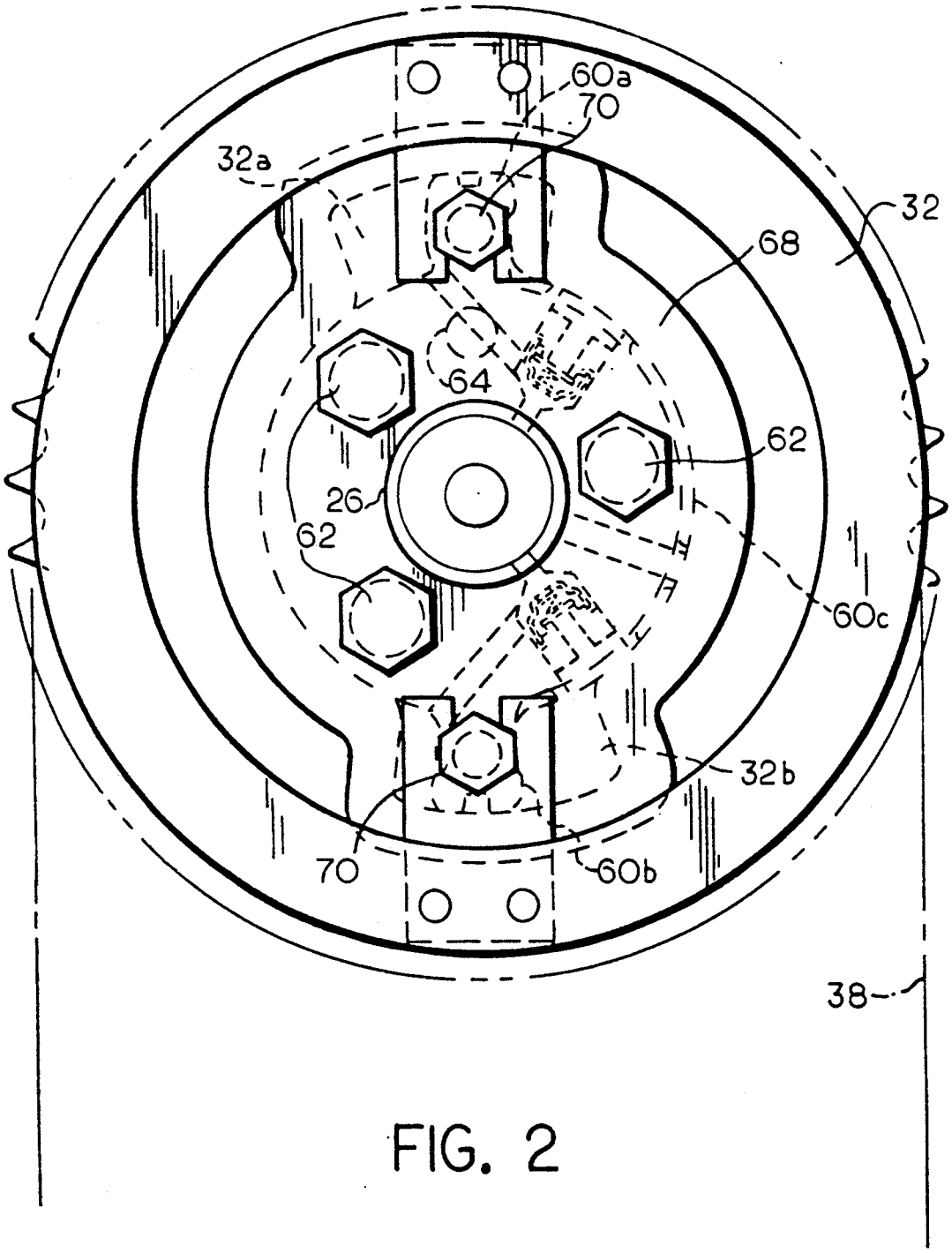
FIG. 2 is an end elevational view of a camshaft with an embodiment of a variable camshaft timing system applied thereto.
Figure 3:
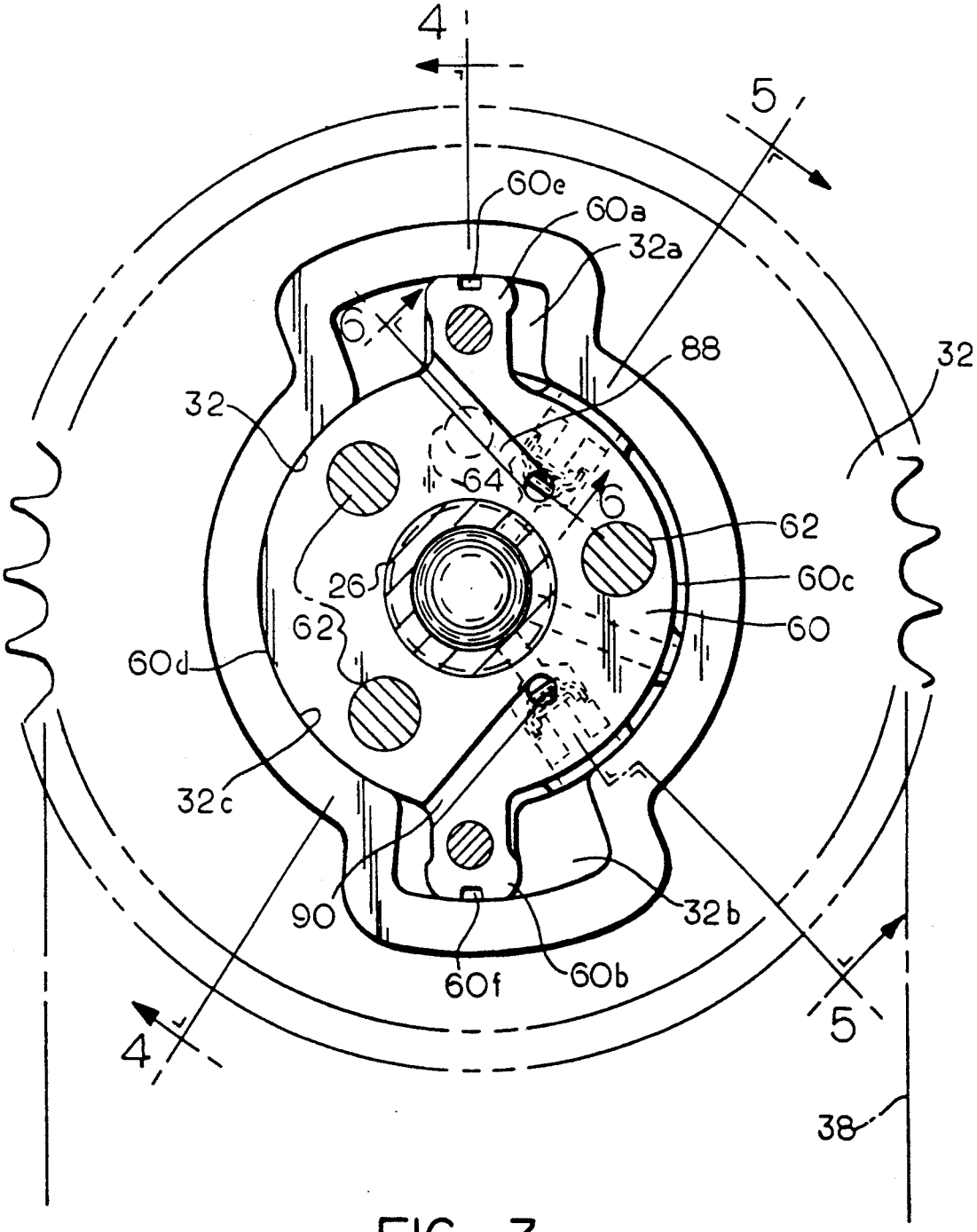
FIG. 3 is a view similar to FIG. 2 with a portion of the structure thereof removed to more clearly illustrate other portions thereof.

FIG. 1*h* is a block diagram of the synchronous filter with variables as follows:

$z^{-1}$ = delay by one camshaft measurement pulse $B = -2\cos(2\pi m/n)$ $A = 1/(2+B)$ FIGS. 2–10 illustrate an embodiment of a hydraulic vane system in which a housing in the form of a sprocket 32 is oscillatingly journalled on a camshaft 26. The camshaft 26 may be considered to be the only camshaft of a single camshaft engine, either of the overhead camshaft type or the inblock camshaft type. Alternatively, the camshaft 26 may be considered to be either the intake valve operating camshaft or the exhaust valve operating camshaft of the dual camshaft engine. In any case, the sprocket 32 and the camshaft 26 are rotatable together, and are caused to rotate by the application of torque to the sprocket 32 by an endless roller chain 38, shown fragmentarily, which is trained around the sprocket 32 and also around a crankshaft not shown. As will be here after described in greater detail, the sprocket 32 is oscillatingly journalled on the camshaft 26 so that it is oscillatable at least through a limited arc with respect to the camshaft 26 during the rotation of the camshaft, an action which will adjust the phase of the camshaft 26 relative to the crankshaft.

An annular pumping vane 60 is fixedly positioned on the camshaft 26, the vane 60 having a diametrically opposed pair of radially outwardly projecting lobes 60*a*, 60*b* and being attached to an enlarged end portion 26*a* of the camshaft by bolts 62 which pass through the vane 60 into the end portion 26*a*. In that regard, the camshaft 26 is also provided with a thrust shoulder 26*b* to permit the camshaft to be accurately positioned relative to an associated engine block, not shown. The pumping vane 60 is also precisely positioned relative to the end portion 26*a* by a dowel pin 64 which extends therebetween. The lobes 60*a*, 60*b* are received in radially outwardly projecting recesses 32*a*, 32*b*, respectively, of the sprocket 32, the circumferential extent of each of the recesses 32*a*, 32*b* being somewhat greater than the circumferential extent of the vane lobes 60*a*, 60*b* which are received in such recesses to permit limited oscillating movement of the sprocket 32 relative to the vane 60. The recesses 32*a*, 32*b* are closed around the lobes 60*a*, 60*b*, respectively, by spaced apart, transversely extending annular plates 66, 68 which are fixed relative to the vane 60, and, thus, relative to the camshaft 60, by bolts 70 which extend from one to the other through the same lobe, 60*a* or 60*b*. Further, the inside diameter 32*c* of the sprocket 32 is sealed with respect to the outside diameter of the portion 60*d* of the vane 60 which is between the lobe 60*a*, 60*b*, and the tips of the lobes 60*a*, 60*b* of the vane 60 are provided with sealed receiving slots 60*e*, 60*f*, respectively. Thus, each of the recesses 32*a*, 32*b* of the sprocket 32 is capable of sustaining hydraulic pressure, and within each recess 32*a*, 32*b*, the portion on each side of the lobe 60*a*, 60*b*, respectively, is capable of sustaining hydraulic pressure.

The functioning of the structure of the embodiment of FIGS. 2–10, as thus far described, may be understood by reference to FIG. 11. Hydraulic fluid, illustratively in the form of engine lubricating oil, flows into the recesses 32*a*, 32*b* by way of a common inlet line 82. The inlet line 82 terminates at a juncture between opposed check valves 84 and 86 which are connected to the recesses 32*a*, 32*b*, respectively, by branch lines 88, 90, respectively. The check valves 84, 86 have annular seats 84*a*, 86*a*, respectively, to permit the flow of hydraulic fluid through the check valves 84, 86 into the recesses 32*a*, 32*b*, respectively. The flow of hydraulic fluids through the check valves 84, 86, is blocked by floating balls 84*b*, 86*b*, respectively, which are resiliently urged against the seats 84*a*, 86*a*, respectively, by springs 84*c*, 86*c*, respectively. The check valves 84, 86, thus, permit the initial filling of the recesses 32*a*, 32*b* and provide for a continuous supply of makeup hydraulic fluid to compensate for leakage therefrom. Hydraulic fluid enters the line 82 by way of a spool valve 92, which is incorporated within the camshaft 26, and hydraulic fluid is returned to the spool valve 92 from the recesses 32*a*, 32*b* by return lines 94, 96, respectively. Because of the location of the check valves 84 and 86 which block the backflow of hydraulic fluid, the need for the spool 100 to return to the null (centered) position to prevent such backflow is eliminated.

The spool valve 92 is made up of a cylindrical member 98 and a spool 100 which is slidable to and fro within the member 98. The spool 100 has cylindrical lands 100*a* and 100*b* on opposed ends thereof, and the lands 100*a* and 100*b*, which fit snugly within the member 98, are positioned so that the land 100*b* will block the exit of hydraulic fluid from the return line 96, or the land 100*a* will block the exit of hydraulic fluid from the return line 94, or the lands 100*a* and 100*b* will block the exit of hydraulic fluid from both return lines 94 and 96, as is shown in FIG. 11, where the camshaft 26 is being maintained in a selective intermediate position relative to the crankshaft of the associated engine.

Figure 4:
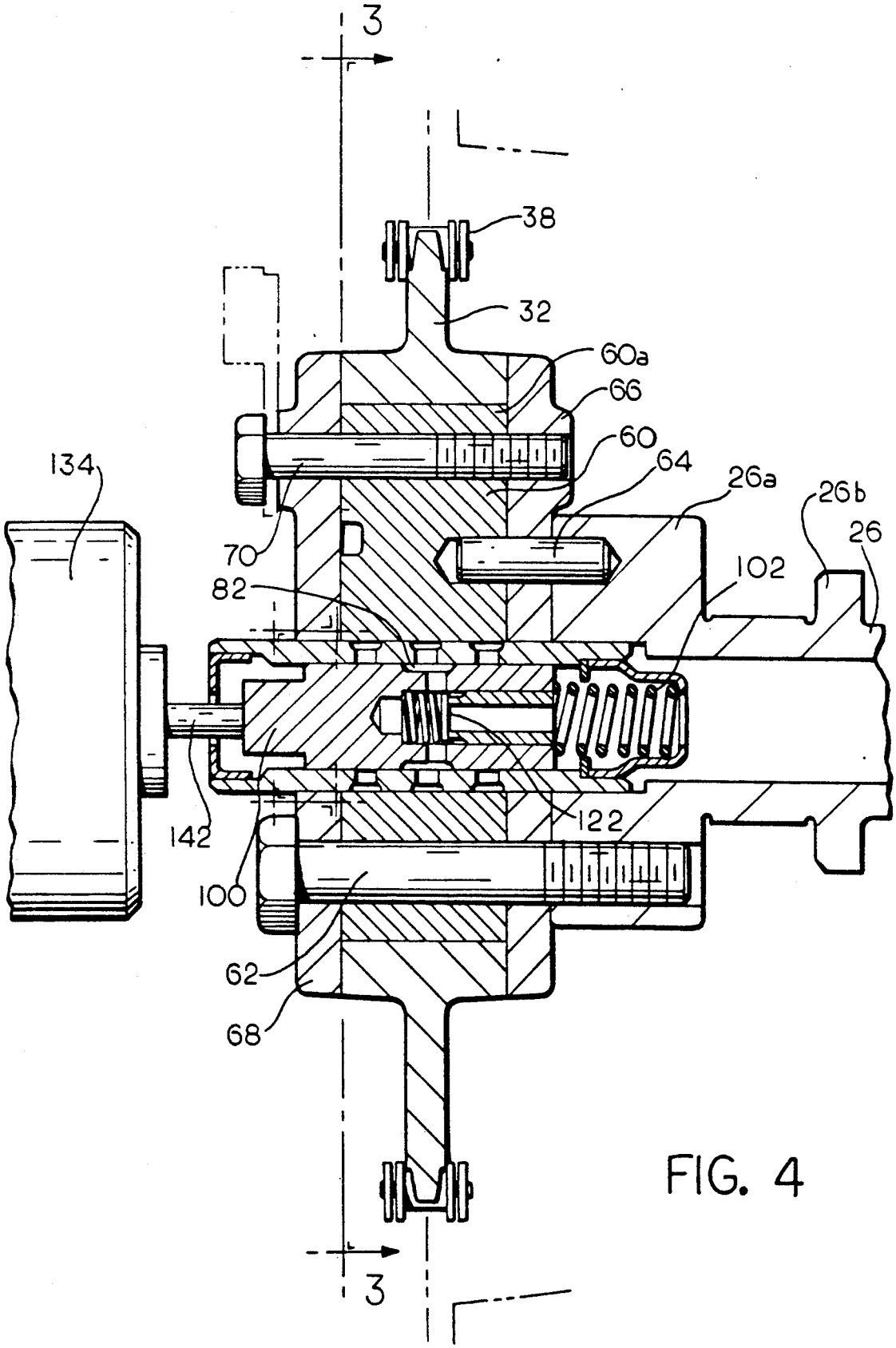
FIG. 4 is a sectional view taken on line 4—4 of FIG. 3.
Figure 5:
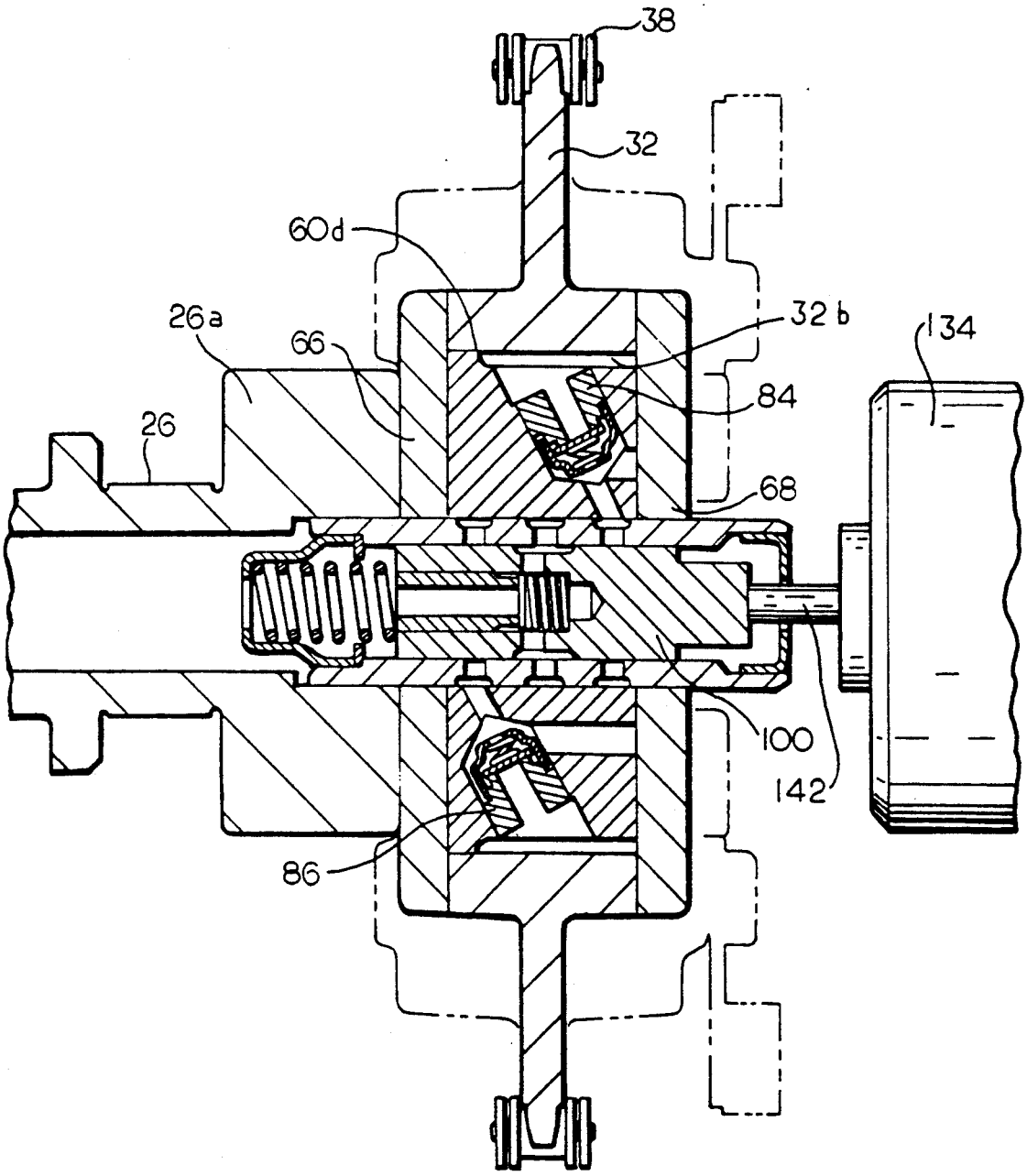
FIG. 5 is a sectional view taken on line 5—5 of FIG. 3.
Figure 7:
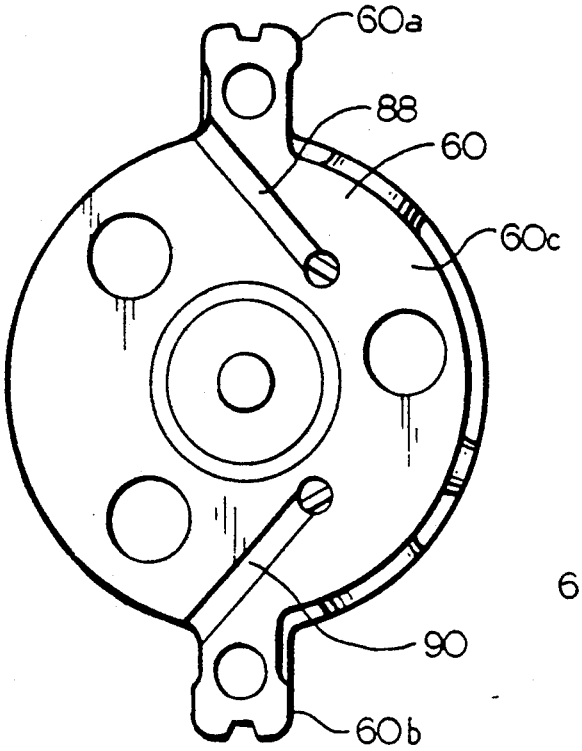
FIG. 7 is a end elevational view of an element of the variable camshaft timing system of FIGS. 2—6.
Figure 8:
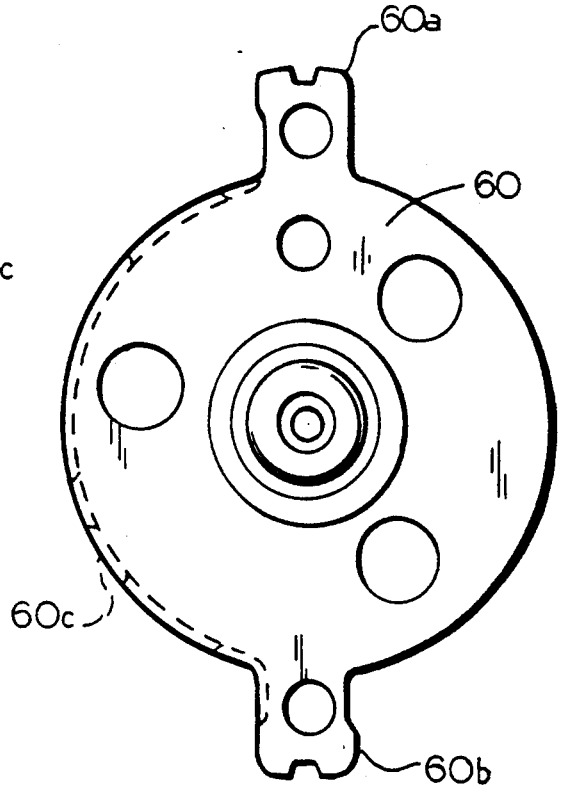
FIG. 8 is an elevational view of the element of FIG. 7 from the opposite end thereof.
Figure 6:
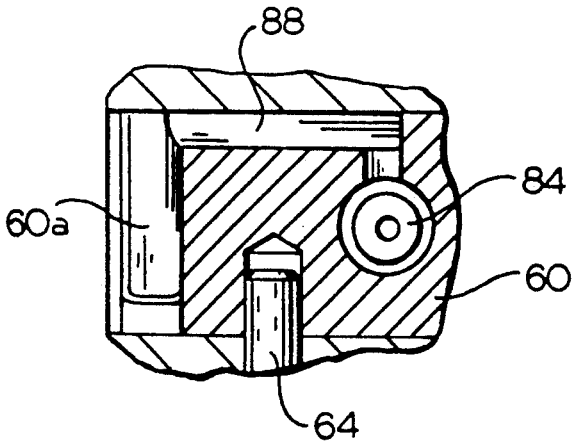
FIG. 6 is a sectional view taken on line 6—6 of FIG. 3.
Figure 9:
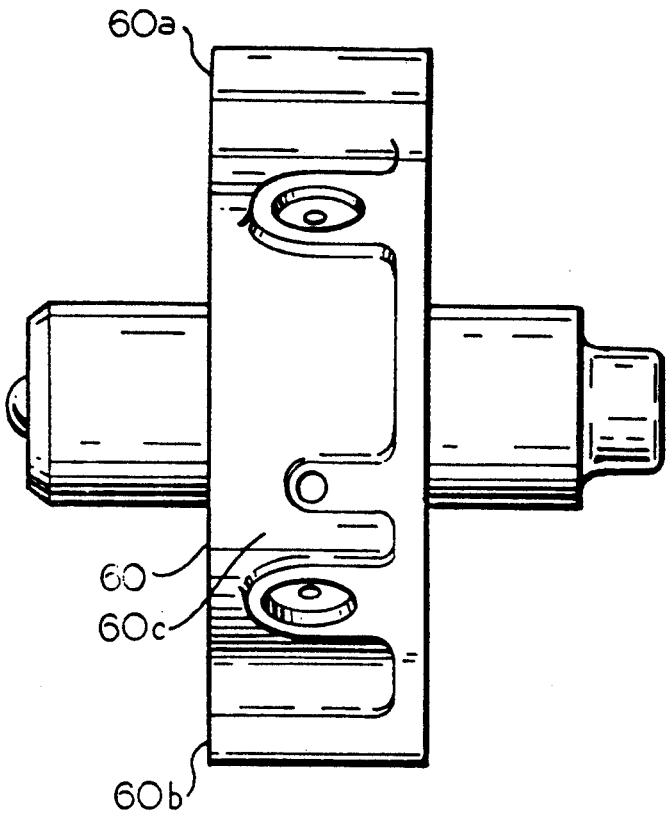
FIG. 9 is a side elevational view of the element of FIGS. 7 and 8.
Figure 10:
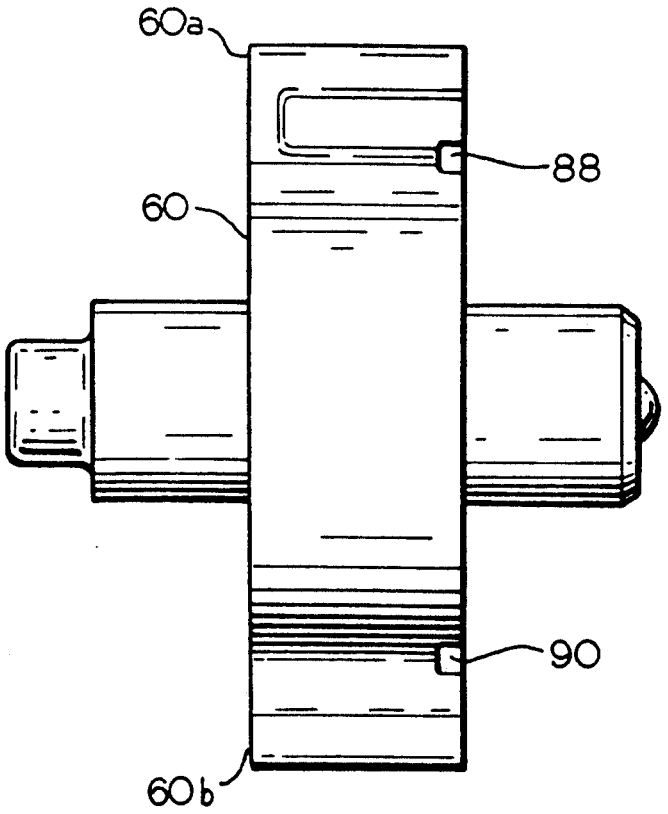
FIG. 10 is an elevational view of the element of FIG. 9 from the opposite side thereof.

Control of the spool 100 within the member 98 is in response to a force from lead screw 142 of stepper motor 134 which bears against the land 100*b* of the spool 100. The stepper motor 134 is an electromechanical device in which lead screw 142 can achieve a number of discrete positions. These positions are available sequentially as a result of a series of step commands. That is, a sequence of "n" step pulses moves the motor, and thus lead screw 142, "n" steps. These steps can be in either a forward or reverse direction. In the present VCT system, spool 100 position corresponds directly with the stepper motor 134 step position through lead screw 142 and is controlled by controller 208 as described above. As is shown in FIGS. 4 and 5, the stepper motor 134 assembly may be mounted at an exposed end of the camshaft 26 so that the lead screw 142 can bear against an end of land 100*b*.

The position of the spool 100 within the member 98 is influenced by spring 102 which acts on the end of land 100*a* to resiliently urge the spool 100 to the left, in the orientation illustrated in FIG. 11. The position of the spool 100 within the member 98 is further influenced by pressurized hydraulic fluid within a portion 98*a* of the member 98, on the outside of the land 100*a*, which urges the spool 100 to the left. The portion 98*a* of the member 98 receives its pressurized fluid (engine oil) directly from the main oil gallery ("MOG") 130 of the engine, and this oil is also used to lubricate a bearing 132 in which the camshaft 26 of the engine rotates.

The vane 60 is alternating urged in clockwise and counter clockwise directions by the torque pulsation in the camshaft 26 and these torque pulsations tend to oscillate the vane 60, and, thus, the camshaft 26, relative to the sprocket 32. However, in the FIG. 11 position of the spool 100 within the cylindrical member 98, such oscillation is prevented by the hydraulic fluid within the recesses 32*a*, 32*b* of the sprocket 32 on opposite sides of the lobes 60*a*, 60*b*, respectively, of the vane 60, because no hydraulic fluid can leave either of the recesses 32*a*, 32*b*, since both return lines 94, 98 are blocked by the position of the spool 100. If, for example, it is desired to permit the camshaft 26 and vane 60 to move in a counter clockwise with respect to the sprocket 32, it is only necessary to step the motor 134 such that lead screw 142 moves to the right. This will urge the spool 100 to right and thereby unblock the return line 94. In this condition of the apparatus, counter clockwise torque pulsations in the camshaft 26 will put fluid out of the portion of the recess 32*a* and allow the lobe 60*a* of vane 60 to move into the portion of the recess which has been emptied of hydraulic fluid. However, reverse movement of the vane will not occur as the pulsations in the camshaft become oppositely directed unless and until the spool 100 moves to the left, because of the blockage of the fluid flow through the return line 96 by the land 100*b* of the spool 100. Thus, large pressure variations induced by camshaft torque pulses will not affect the condition of the system, eliminating the need to synchronize the opening and closing of the spool valve 92 with individual torque pulses. While illustrated as a separate closed passage in FIG. 11, the periphery of the vane 60 actually has an open oil passage slot, element 60*c* in FIGS. 2–10, which permits the transfer of oil between the portion of the recess 32*a* on the right side of the lobe 60*a* and the portion of the recess 32*b* on the right side of the lobe 60*b*, which are the nonactive sides of the lobes 60*a* and 60*b*; thus, counter clockwise movement of the vane 60 relative to the sprocket 32 will occur when flow is permitted through return line 94 and clockwise movement will occur when flow is permitted through return line 96.

Further, the passage 82 is provided with an extension 82*a* to the nonactive side of one of the lobes 60*a* or 60*b*, shown as the lobe 60*b*, to permit a continuous supply of makeup oil to the nonactive sides of the lobes 62*a* and 62*b* for better rotational balance, improved damping of vane motion, and improved lubrication of the bearing surfaces of the vane 60.

Makeup oil for the recesses 32*a*, 32*b* of the sprocket 32 to compensate for leakage therefrom is provided by way of a small, internal passage 120 within the spool 100, from the passage 98*a* to annular space 98*b* of the cylindrical member 98, from which it can flow into the inlet line 82. A check valve 122 is positioned within the passage 120 to block the flow of oil from the annular space 98*b* to the portion 98*a* of the cylindrical member 98.

The elements of the structure of FIGS. 2–10 which correspond to the elements of FIG. 11, as described above, are identified in FIGS. 2–10 by the referenced numerals which were used in FIG. 11, it being noted that the check valves 84 and 86 are disc type check valves in FIGS. 2–10 as opposed to the ball type check valves of FIG. 11. While this type check valves are preferred for the embodiment of FIGS. 2–10, it is to be understood that other types of check valves can also be used.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In an internal combustion engine having a rotatable crankshaft and a rotatable camshaft, the camshaft being position variable relative to the crankshaft, being subject to torque reversals during the rotation thereof, having a vane with at least one lobe secured to the camshaft for rotation therewith, and having a housing mounted on the camshaft for rotation with the camshaft and for oscillation with respect to the camshaft, the housing having at least one recess receiving the at least one lobe of the vane and permitting oscillation of the at least one lobe within the at least one recess as the housing oscillates with respect to the camshaft, a method comprising:

providing means for transmitting rotational movement from the crankshaft to the housing;

providing actuating means for varying the position of the housing relative to the camshaft in reaction to torque reversals in the camshaft, said actuating means comprising a stepper motor, a lead screw and a proportional spool valve, the position of said spool valve being controlled by the position of the lead screw driven by said stepper motor, said actuating means also delivering hydraulic fluid to said vane; and providing processing means for controlling the position of said actuating means.

2. The method of claim 1 and further providing check valve means functionally positioned between said housing and said actuating means to eliminate the need for blocking a backflow of hydraulic fluid by the operation of said actuating means.

3. The method of claim 1 and further providing sensing means for determining a phase angle between the crankshaft and the camshaft and issuing a feedback signal to said processing means.

4. The method of claim 1 wherein said processing means further comprises means for determining:

desired spool valve acceleration;

desired spool valve velocity; and desired spool valve position.

5. The method of claim 1 wherein said processing means further comprises means for controlling:

stepper motor position gain;

stepper motor velocity gain;

stepper motor acceleration gain; and

VCT phase angle gain.

6. The method of claim 1 and further comprising means for tracking spool valve position.

7. The method of claim 1 wherein said processing means further comprises means for limiting:

spool valve acceleration;

spool valve velocity; and spool valve position.

8. The method according to claim 1 wherein said processing means further comprises means for providing integral control with state variable feedback.

9. The method of claim 1 wherein said processing means further comprises a means for optimally controlling said actuating means.

10. The method of claim 1 wherein said processing means further comprises means to compensate for outside disturbances.

11. The method of claim 1 wherein said processing means further comprises at least one filtering means for compensating for the difference between actual engine dynamics and the estimation of said dynamics.

12. The method according to claim 1 wherein the actuating means comprises means for permitting the position of the housing to move in a first direction relative to the camshaft in reaction to a torque pulse in the camshaft in a first direction, means for preventing the position of the housing from moving relative to the camshaft in a second direction in reaction to a torque pulse in the camshaft in a second direction, and means for selectively reversing the first and second directions of the movement of the housing relative to the camshaft with respect to the first and second directions of torque pulses in the camshaft.

13. The method according to claim 1 wherein the at least one recess is capable of sustaining hydraulic pressure, wherein the at least one lobe divides the at least one recess into a first portion and a second portion, and wherein the varying of the position of the housing relative to the camshaft comprises:

transferring hydraulic fluid into one of the first portion and the second portion of the recess.

14. The method according to claim 13 wherein the varying of the position of the housing relative to the camshaft further comprises;

simultaneously transferring hydraulic fluid out of the other of the first portion and the second portion of the recess.

15. The method according to claim 1 wherein the hydraulic fluid is engine lubricating oil from a main oil gallery of the engine.

16. An internal combustion engine comprising:

a crankshaft, said crankshaft being rotatable about an axis;

a camshaft, said camshaft being rotatable about a second axis, said second axis being parallel to said axis, said camshaft being subject to torque reversals during the rotation thereof;

a vane, said vane having at least one lobe, said vane being attached to said camshaft, being rotatable with said camshaft and being non-oscillatable with respect to said camshaft;

a housing, said housing being rotatable with said camshaft and being oscillatable with respect to said camshaft, said housing having at least one recess, said at least one recess receiving said at least one lobe, said at least one lobe being oscillatable within said at least one recess;

rotary movement transmitting means for transmitting rotary movement from the crankshaft to the housing;

actuating means for varying the position of the housing relative to the camshaft in reaction to torque reversals in the camshaft, said actuating means comprising a stepper motor, a lead screw and a proportional spool valve, the position of said spool valve being controlled by the position of the lead screw driven by said stepper motor, said actuating means also delivering hydraulic fluid to said vane; and processing means for controlling the position of said actuating means.

17. The engine according to claim 16 and further comprising:

sensing means for determining a phase angle between the crankshaft and the camshaft and issuing a feedback signal to said processing means; and check valve means functionally positioned upstream of said vane for eliminating the need for blocking a backflow of hydraulic fluid by the operation of said means for varying the position of said housing.

18. The engine according to claim 17 wherein said processing means further comprises means for determining:

desired spool valve acceleration;

spool valve velocity; and desired spool valve position.

19. The engine according to claim 17 wherein said processing means further comprises means for controlling:

stepper motor position gain;

stepper motor velocity gain;

stepper motor acceleration gain; and

7 VCT phase angle gain.

20. The engine according to claim 17 and further comprising means for tracking spool valve position.

21. The engine according to claim 17 wherein said processing means further comprises means for limiting:

spool valve acceleration;

spool valve velocity; and spool valve position.

22. The engine according to claim 17 wherein said processing means further comprises means for providing integral control with state variable feedback.

23. The engine according to claim 17 wherein said processing means further comprises a means for optimally controlling said actuating means.

24. The engine according to claim 17 wherein said processing means comprises means to compensate for outside disturbances.

25. The engine according claim 17 wherein said processing means further comprises at least one filtering means for compensating for the difference between actual engine dynamics and the estimation of said dynamics.

26. The engine according to claim 17 wherein said at least one lobe divides said at least one recess into a first portion and a second portion, and wherein said means reactive to torque reversals comprises means for transferring hydraulic fluid into one of said first portion and said second portion, said one of said first portion and said second portion of said at least one recess being capable of sustaining hydraulic pressure.

27. The engine according to claim 26 wherein said means reactive to torque reversals further comprises means for simultaneously transferring hydraulic fluid out of the other of said first portion and said second portion.

28. The engine according to claim 26 wherein each of said first portion and said second portion of said at least one recess is capable of sustaining hydraulic pressure, and wherein said means reactive to torque reversals is capable of being reversed to transfer hydraulic fluid out of said one of said first portion and said second portion and to transfer hydraulic fluid into said other of said first portion and said second portion, said engine further comprising:

an engine control unit responsive to at least one engine operating condition for selectively reversing the operation of said means reactive to torque reversals.

29. An engine according to claim 17 wherein said hydraulic fluid comprises engine lubricating oil, and further comprising:

conduit means for transferring engine lubricating oil from a portion of said engine to said control means; and second conduit means for transferring engine lubricating oil from said control means to said portion of said engine.

* * * * *